US010603712B2

(12) United States Patent
Yamamoto et al.

(10) Patent No.: US 10,603,712 B2
(45) Date of Patent: Mar. 31, 2020

(54) METHOD OF INCREASING THICKNESS OF TUBE AND INCREASED THICKNESS TUBE

(71) Applicant: NIPPON STEEL & SUMIKIN STAINLESS STEEL CORPORATION, Tokyo (JP)

(72) Inventors: Shuji Yamamoto, Tokyo (JP); Junichi Hamada, Tokyo (JP); Atsuhisa Yakawa, Tokyo (JP); Mitsuhiro Fujinaga, Tokyo (JP)

(73) Assignee: NIPPON STEEL & SUMKIN STAINLESS STEEL CORPORATION, Tokyo (JP)

( * ) Notice: Subject to any disclaimer, the term of this patent is extended or adjusted under 35 U.S.C. 154(b) by 257 days.

(21) Appl. No.: 15/556,747

(22) PCT Filed: Mar. 8, 2016

(86) PCT No.: PCT/JP2016/057192

§ 371 (c)(1),
(2) Date: Sep. 8, 2017

(87) PCT Pub. No.: WO2016/143791

PCT Pub. Date: Sep. 15, 2016

(65) Prior Publication Data

US 2018/0056370 A1 Mar. 1, 2018

(30) Foreign Application Priority Data

Mar. 10, 2015 (JP) ..... 2015-047475

(51) Int. Cl.
*B21J 5/00* (2006.01)
*B21J 5/08* (2006.01)
*B21D 41/02* (2006.01)

(52) U.S. Cl.
CPC ..... *B21J 5/08* (2013.01); *B21D 41/026* (2013.01)

(58) Field of Classification Search
CPC ..... B21C 37/16; B21C 25/02; B21C 25/04; B21D 19/02; B21D 19/06; B21D 19/08;
(Continued)

(56) References Cited

U.S. PATENT DOCUMENTS 1,104,088 A * 7/1914 Wales ..... B21D 51/40 29/512
4,213,322 A * 7/1980 Barnes, Jr. ..... B21J 5/08 72/357

(Continued)

FOREIGN PATENT DOCUMENTS

DE 102010015834 A1 10/2011
JP 10-507410 A 7/1998

(Continued)

OTHER PUBLICATIONS

Chinese Office Action and Search Report, dated Mar. 1, 2019, for corresponding Chinese Application No. 201680014301.7.

(Continued)

*Primary Examiner* — Debra M Sullivan
*Assistant Examiner* — Matthew Kresse
(74) *Attorney, Agent, or Firm* — Birch, Stewart, Kolasch & Birch, LLP

(57) ABSTRACT

A method of increasing the thickness of a tube which increases a thickness of an end part of a tube without a burr being formed, comprising placing a tube 21 between a die 25 and mandrel 22 in the state with a space for increasing the thickness between a small diameter part 22*a* of the mandrel 22 and a first end part 21*a* of a tube 21 and between a large diameter hole part 25C of the die 25 and a second end part 21*b* of the tube 21, using a first upsetting punch 23 and a second upsetting punch 24 to respectively process the first end part 21*a* and the second end part 21*b* of the tube 21, pulling out the mandrel 22 from the tube 31 in the state with the second upsetting punch 24 constraining the second end part 31*b* of the tube 31, and using the first upsetting punch 23 to push up the first end part 31*a* of the tube 31 to take out the tube 31 from the die 25.

1 Claim, 5 Drawing Sheets

(58) Field of Classification Search
CPC .... B21D 19/10; B21D 41/025; B21D 41/026; B21D 41/02; B21J 13/025; B21J 5/08; B21J 5/12; B21J 9/027; B21J 9/06
USPC ... 72/370.01, 370.02, 370.03, 370.1, 370.13, 72/370.14, 370.15
See application file for complete search history.

(56) References Cited

U.S. PATENT DOCUMENTS

| | | | | |
|---|---|---|---|---|
| 5,956,988 | A | 9/1999 | Beste et al. | |
| 7,644,601 | B2 * | 1/2010 | Brochheuser | B21C 1/24 72/283 |
| 2007/0204668 | A1 | 9/2007 | Shiokawa | |

FOREIGN PATENT DOCUMENTS

| | | | |
|---|---|---|---|
| JP | 11-333537 | A | 12/1999 |
| JP | 2007-275896 | A | 10/2007 |

OTHER PUBLICATIONS

English translation of Chinese Office Action dated Mar. 1, 2019 for Application No. 201680014301.7.
International Search Report for PCT/JP2016/057192 dated Apr. 19, 2016.
Written Opinion of the International Searching Authority for PCT/JP2016/057192 (PCT/ISA/237) dated Apr. 19, 2016.

* cited by examiner

METHOD OF INCREASING THICKNESS OF TUBE AND INCREASED THICKNESS TUBE

TECHNICAL FIELD

The present invention relates to a method of increasing the thickness of a tube which increases the thickness of an end part of a tube and to an increased thickness tube increased in thickness by this.

BACKGROUND ART

As prior art for increasing the thickness of an end part of a tube, for example, there is the one disclosed in PLT 1. In the method of PLT 1, as shown in FIG. 1A, a tube 1 is placed in the middle of an upper die 2 and a lower die 3, then an upsetting punch 4 is pushed against this in the arrow direction to increase the thickness of an end part of the tube 1 as shown in FIG. 1B.

CITATION LIST

Patent Literature

PLT 1: Japanese Patent Publication No. 59-88210A

SUMMARY OF INVENTION

Technical Problem

With the method of PLT 1, two split dies 2 and 3 are used, so after increasing the thicknesses of the two ends, the tube can be removed from the dies 2 and 3 and upsetting punch 4. However, as shown in FIG. 1C, the dies 2 and 3 are formed with chamfered parts 2a and 3a considering the fact that the outer surface of the tube 1 enters into the clearance between the upper die 2 and lower die 3 when increasing the thickness, but there is the problem that a burr is formed at the boundary part of the split dies 2 and 3.

The present invention was made in consideration of the above situation and has as its object to enable an increase of thickness of an end part of a tube without a burr being formed.

Solution to Problem

To achieve the above object, the gist of the method of increasing the thickness of a tube of the present invention is as follows:

A method of increasing the thickness of a tube which increases a thickness of an end part of a tube having a first end part and a second end part, the method of increasing the thickness of a tube comprising using a mandrel having a small diameter part, a slanted surface part expanded in diameter continuing from the small diameter part, and a large diameter part continuing from the slanted surface part, a die having a small diameter hole part, a slanted hole surface part expanded in hole diameter following the small diameter hole part, and a large diameter hole part following the slanted hole surface part, a first upsetting punch arranged along the small diameter part of the mandrel and the small diameter hole part of the die, and a second upsetting punch arranged along the large diameter part of the mandrel and the large diameter hole part of the die so as to place the tube between the die and the mandrel, process the first end part of the tube by the first upsetting punch, and, further, process the second end part of the tube by the second upsetting punch to increase the thickness; pulling out the mandrel from the tube in the state using the second upsetting punch to constrain the second end part of the tube; and using the first upsetting punch to push up the first end part of the tube to take out the tube from the die.

Further, the increased thickness tube of the present invention is an increased thickness tube produced by the method of increasing the thickness of a tube of the present invention, the increased thickness tube characterized by having an end part increased in thickness to an inner surface side and an end part increased in thickness to an outer surface side.

Advantageous Effects of Invention

According to the present invention, it is possible to increase the thickness of an end part of a tube without a burr being formed.

BRIEF DESCRIPTION OF DRAWINGS

FIGS. 1A to 1C are views showing a conventional press die, wherein FIG. 1A is a cross-sectional view showing the state before increasing the thickness, FIG. 1B is a cross-sectional view showing the state after increasing the thickness, and FIG. 1C is a cross-sectional view along the line X-X of FIG. 1A.

DESCRIPTION OF EMBODIMENT

Figure 1:
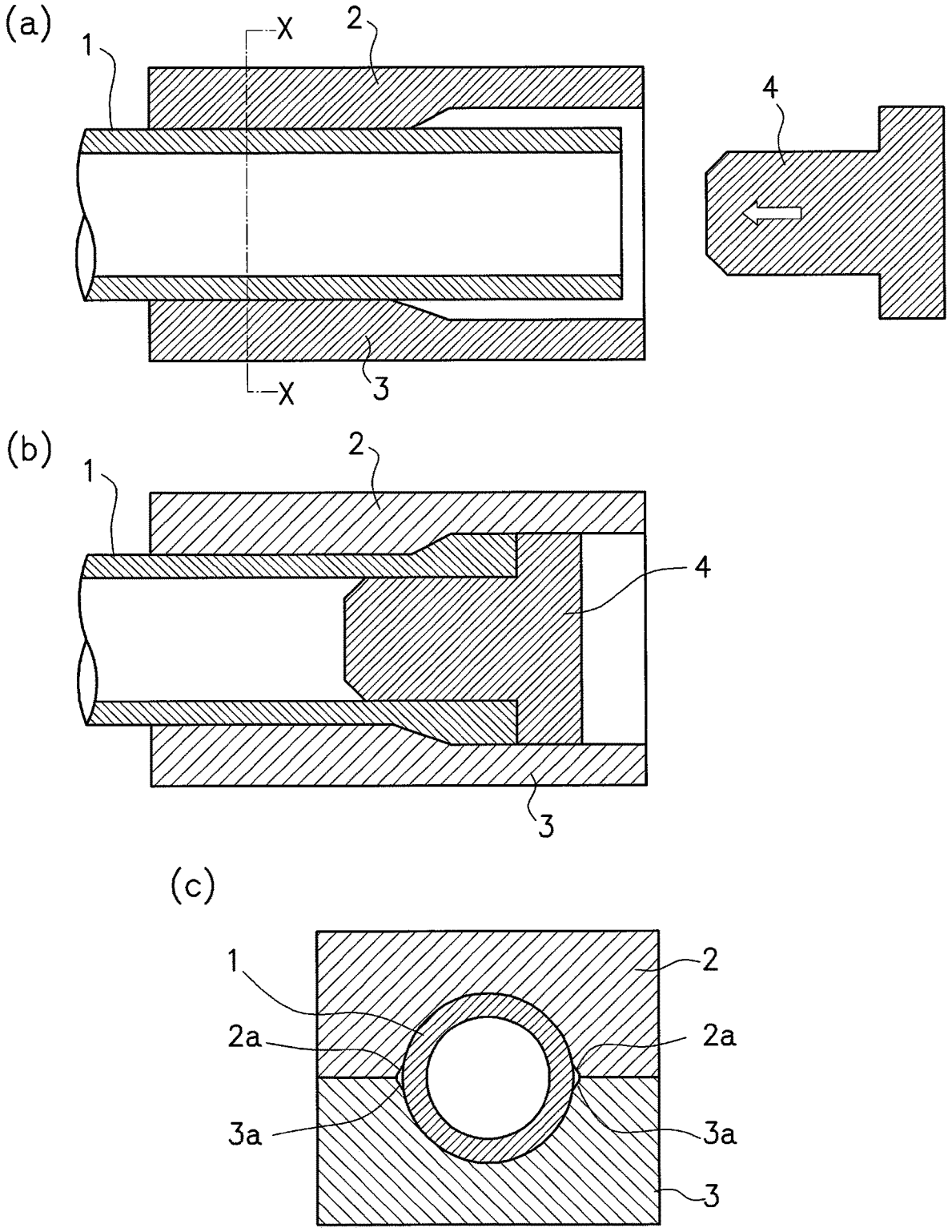

Below, referring to the attached drawings, a preferred embodiment of the present invention will be explained.

FIG. 2 to FIG. 5 are cross-sectional views showing the general outlines of a press die according to the embodiment. The press die is placed in a press machine. Note that the side cross-section of the press die is axially symmetric, so in the figures, only one side part from the center axis 20 is shown.

The press die is comprised of a mandrel 22, first upsetting punch 23, second upsetting punch 24, and die 25 with center axes 20 arranged coaxially. The mandrel 22, first upsetting punch 23, and second upsetting punch 24 are movable types able to be raised and lowered by a not shown lift mechanism, while the die 25 is a fixed type. For the lift mechanism, hydraulics, a servo motor, etc. may be used.

The tube 21 is a tube which has a first end part 21*a* and a second end part 21*b* and is constant in wall thickness from one end to the other end. For the tube 21, ordinary steel, stainless steel, aluminum, titanium, or other plastically formable material may be used.

The mandrel 22 has a small diameter part 22*a*, a slanted surface part 22*b* of a substantially frustoconical side shape with an expanding diameter continuing from the small diameter part 22*a*, and a large diameter part 22*c* continuing from the slanted surface part 22*b*. The outside diameter of the large diameter part 22*c* is substantially equal to the inside diameter of the tube 21. The outside diameter of the small diameter part 22*a* is smaller than the outside diameter of the large diameter part 22*c* for increasing the thickness of the first end part 21*a* of the tube 21.

The die 25 has a small diameter hole part 25*a*, a slanted hole surface part 25*b* of a substantially frustoconical side shape with an expanding hole diameter continuing from the small diameter hole part 25*a*, and a large diameter hole part 25*c* continuing from the slanted hole surface part 25*b*. The inside diameter of the small diameter hole part 25*a* is substantially equal to the outside diameter of the tube 21. The inside diameter of the large diameter hole part 25*c* is larger than the inside diameter of the small diameter hole part 25*a* for increasing the thickness of the second end part 21*b* of the tube 21.

The first upsetting punch 23 is arranged along the small diameter part 22*a* of the mandrel 22 and the small diameter hole part 25*a* of the die 25 and is substantially cylindrical in shape. The inside diameter of the first upsetting punch 23 is substantially equal to the outside diameter of the small diameter part 22*a* of the mandrel 22. The outside diameter of the first upsetting punch 23 is substantially equal to the inside diameter of the small diameter hole part 25*a* of the die 25.

The second upsetting punch 24 is arranged along the large diameter part 22*c* of the mandrel 22 and the large diameter hole part 25*c* of the die 25 and is substantially cylindrical in shape. The inside diameter of the second upsetting punch 24 is substantially equal to the outside diameter of the large diameter part 22*c* of the mandrel 22. The outside diameter of the second upsetting punch 24 is substantially equal to the inside diameter of the large diameter hole part 25*c* of the die 25.

Below, the operation of increasing the thickness of the tube 21 by the press die according to the present embodiment will be explained.

Figure 2:
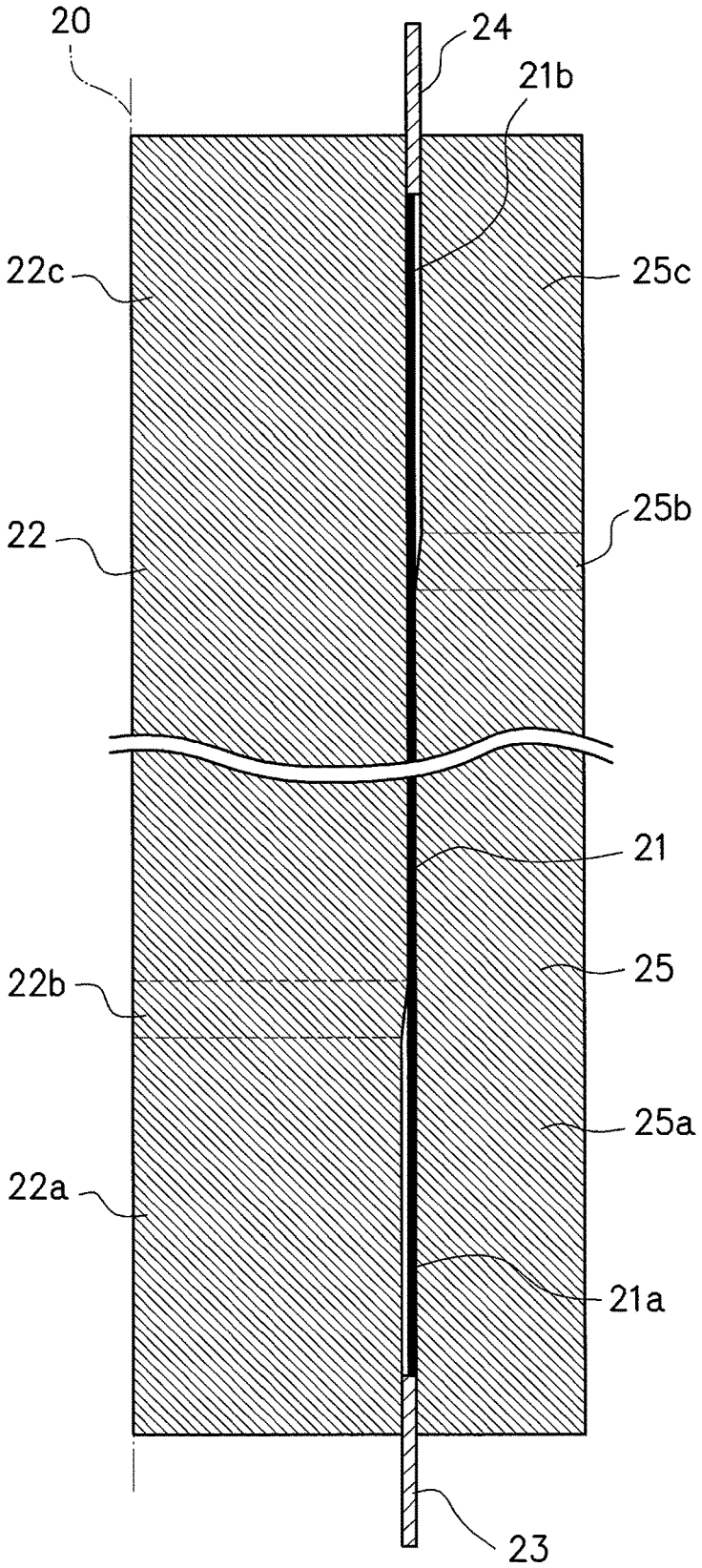
FIG. 2 is a cross-sectional view showing the state of a press die according to an embodiment before increasing the thickness.

As shown in FIG. 2, the tube 21 is placed between the die 25 and the mandrel 22. In this state, there are spaces for increasing the thickness between the small diameter part 22*a* of the mandrel 22 and the first end part 21*a* of the tube 21 and between the large diameter hole part 25C of the die 25 and the second end part 21*b* of the tube 21.

Figure 3:
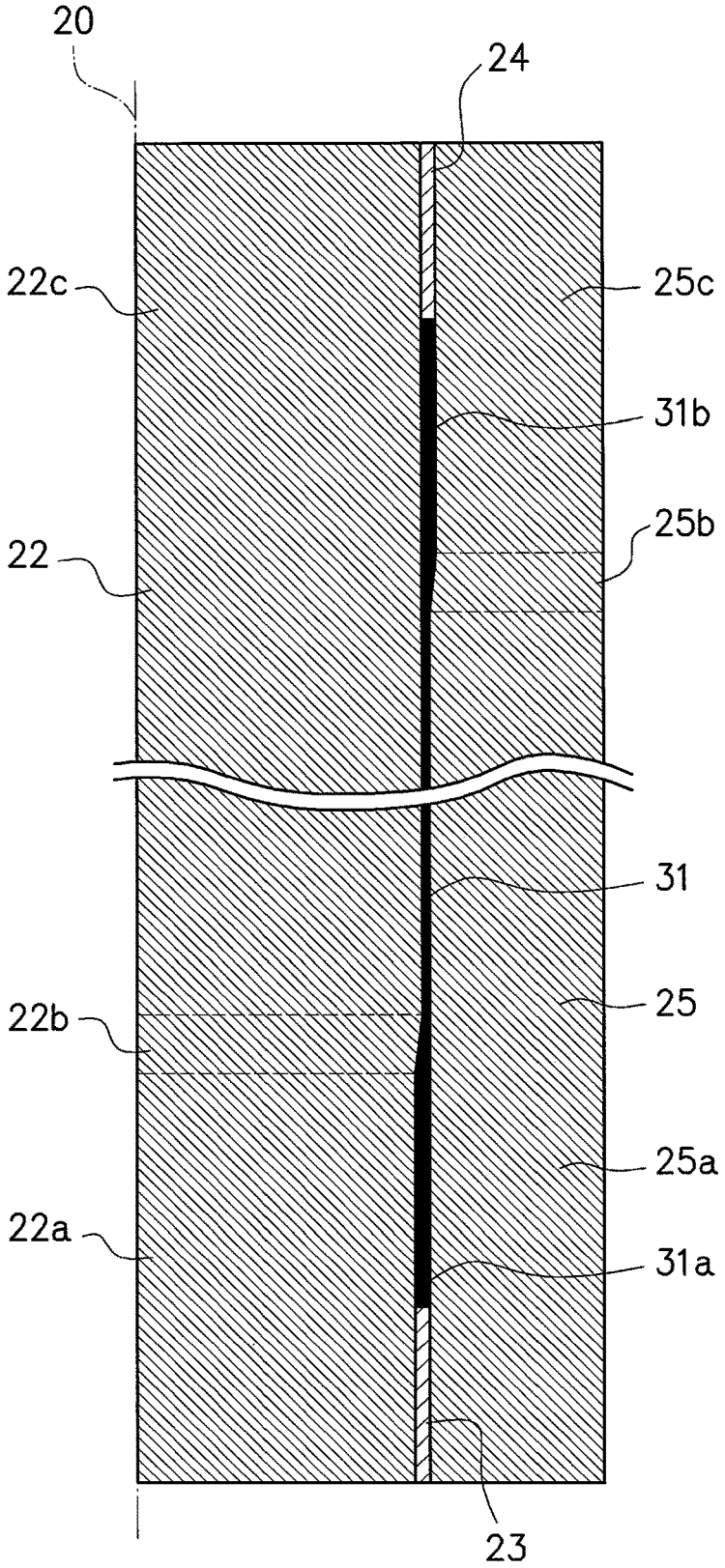
FIG. 3 is a cross-sectional view showing the state of a press die according to an embodiment after increasing the thickness of an end part of a tube.

Next, as shown in FIG. 3, the first upsetting punch 23 and the second upsetting punch 24 are used to upset the first end part 21*a* and the second end part 21*b* of the tube 21 and increase the thickness. The tube after being increased in thickness is assigned reference numeral 31. At the tube 31, the first end part 31*a* is increased in thickness to the inner surface side, while the second end part 31*b* is increased in thickness to the outer surface side.

In this case, the first upsetting punch 23 may be used to process the first end part 21*a* of the tube 21, then the second upsetting punch 24 may be used to process the second end part 21*b* of the tube 21. Alternatively, the second upsetting punch 24 may be used to process the second end part 21*b* of the tube 21, then the first upsetting punch 23 may be used to process the end part 21*a* of the tube 21. Alternatively, the two punches 23 and 24 may be used to simultaneously process the two end parts 21*a* and 21*b* of the tube 21.

Figure 4:
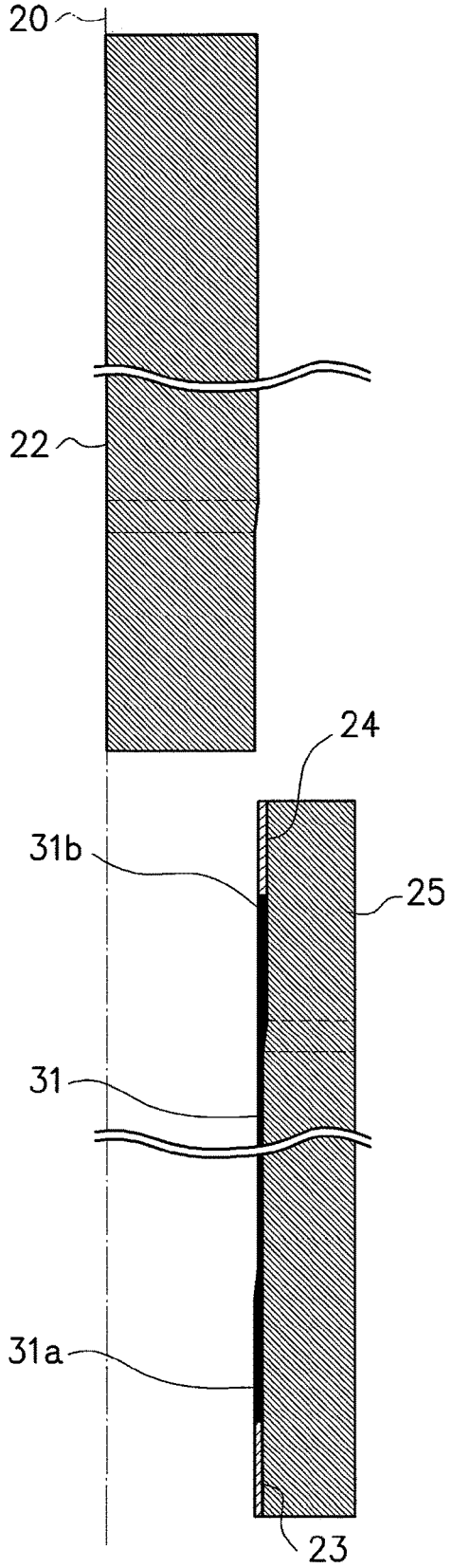
FIG. 4 is a cross-sectional view showing the state of a press die according to an embodiment after pulling out a mandrel from a tube.

Next, as shown in FIG. 4, the mandrel 22 is pulled out from the tube 31 in the state with the second upsetting punch 24 constraining the second end part 31*b* of the tube 31. The second end part 31*b* of the tube 31 is increased in thickness to the outer surface side (that is, the die 25 side), but is not increased in thickness to the inner surface side (that is, the mandrel 22 side), so the mandrel 22 can be pulled out from the tube 31.

Figure 5:
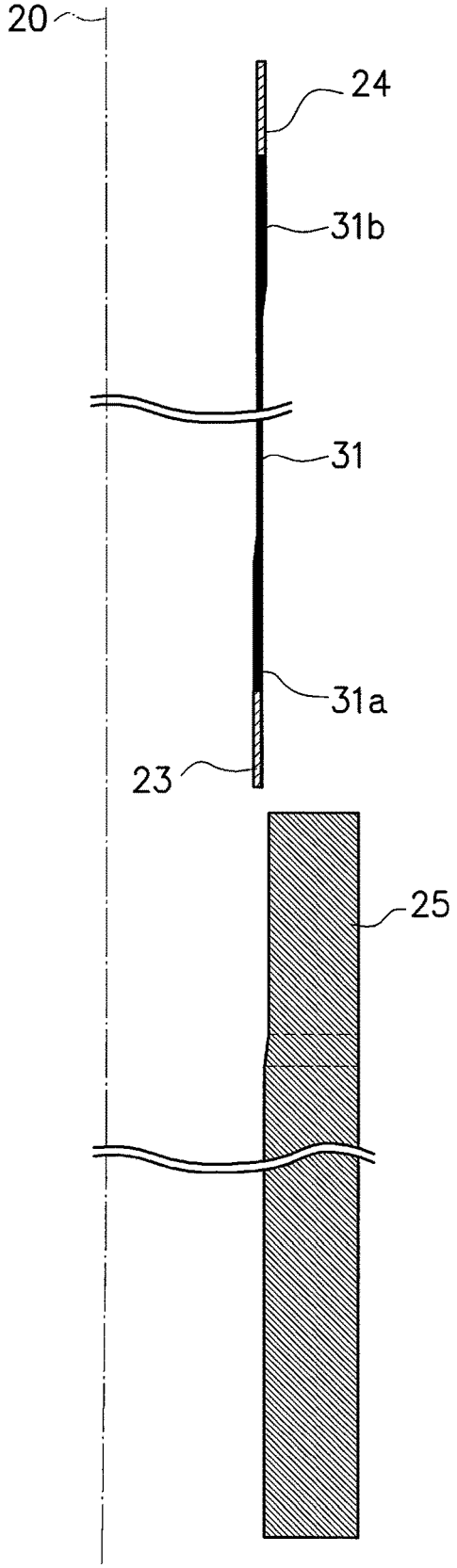
FIG. 5 is a cross-sectional view showing the state of a press die according to an embodiment after pulling out a tube from the die.

Next, as shown in FIG. 5, the first upsetting punch 23 is used to push up the first end part 31*a* of the tube 31 to take out the tube 31 from the die 25.

As explained above, by increasing the thickness of one end part to the inner surface side and increasing the thickness of the other end part to the outer surface side, even if using a single-piece die, it becomes possible to take out the tube from the press die after increasing the thickness. When using a single-piece die to increase the thickness of the two ends of the tube to just one of the inner surface side or the outer surface side, it is not possible to take out the tube from the press die after increasing the thickness.

Further, since a single-piece die is used, it is possible to increase the thickness of an end part of the tube without a burr being formed.

The increased thickness tube obtained using the present invention is not particularly limited in application. In particular, the invention is effective when applied to a steel tube used at an exhaust part (for example, a center tube of an exhaust system) of an internal combustion engine (engine) mounted in an automobile, motorcycle, etc. A part used for an automobile or motorcycle is required to be lightened in weight from the viewpoint of the fuel economy efficiency, thermal efficiency, etc. The exhaust tube from the exhaust manifold to the muffler in the parts used for an automobile or motorcycle carries high temperature exhaust gas, so a stainless steel tube excellent in heat resistance and corrosion resistance has been used. Usually, these parts are formed by bending, expanding, or otherwise shaping a steel tube constant in wall thickness, then joining it with other parts. However, from the viewpoint of the heat resistance, corrosion resistance, and structure, each part does not necessarily have to be a steel tube with a constant wall thickness.

Above, the present invention was explained together with an embodiment. The above embodiment only shows a specific example of working the present invention. The technical scope of the present invention must not be interpreted in a limited manner due to these. That is, the present invention can be worked in various ways without departing from its technical idea or main features.

In the above embodiment, an example of increasing the thickness of the two ends of a tube was shown. The present invention also includes increasing the thickness of only one end part to the inner surface side or outer surface side. Further, after increasing the thickness, it is also possible to perform heat treatment or other post-treatment as needed.

REFERENCE SIGNS LIST

20. center axis
21. tube
21*a*. first end part of tube
21*b*. second end part of tube
22. mandrel
22*a*. small diameter part
22*b*. slanted surface part
22*c*. large diameter part
23. first upsetting punch
24. second upsetting punch
25. die
25*a*. small diameter hole part
25*b*. slanted surface part
25*c*. large diameter hole part
31. tube after increase of thickness
31*a*. first end part of tube after increase of thickness
31*b*. second end part of tube after increase of thickness

The invention claimed is:

1. A method of increasing a thickness of both end parts of a tube which increases a thickness of an end part of a tube having a first end part and a second end part, said method of increasing the thickness comprising performing:

a step of using a mandrel having a small diameter part, a slanted surface part expanded in diameter continuing from said small diameter part, and a large diameter part continuing from said slanted surface part, a die having a small diameter hole part, a slanted hole surface part expanded in hole diameter continuing from said small diameter hole part, and a large diameter hole part continuing from said slanted hole surface part, a first upsetting punch arranged along said small diameter part of said mandrel and said small diameter hole part of said die, and a second upsetting punch arranged along said large diameter part of said mandrel and said large diameter hole part of said die thereby inserting a tube workpiece between said die and said mandrel, swaging said first end part of the tube by said first upsetting punch, and further, swaging said second end part of the tube by said second upsetting punch to increase the thickness of the first end part and the second end part, a step of pulling out said mandrel from said tube in a state with the second upsetting punch constraining the second end part of the tube, and a step of using said first upsetting punch to push up said first end part of said tube to take out said tube from said die to thereby form an increased thickness tube with said first end part increased in thickness to an inner surface side of the tube and with said second end part increased in thickness to an outer surface side of the tube.

* * * * *